United States Patent [19]

Inaba et al.

[11] Patent Number: 4,620,204

[45] Date of Patent: Oct. 28, 1986

[54] TWO-COLOR THERMOSENSITIVE RECORDING MATERIAL

[75] Inventors: Norihiko Inaba, Numazu; Kiyotaka Iiyama, Mishima, both of Japan

[73] Assignee: Ricoh Company, Ltd., Tokyo, Japan

[21] Appl. No.: 785,714

[22] Filed: Oct. 9, 1985

[30] Foreign Application Priority Data

Oct. 9, 1984 [JP] Japan ..... 59-213038

[51] Int. Cl.[4] ..... B41M 5/18

[52] U.S. Cl. ..... 346/204; 346/205; 346/208; 346/216; 346/225; 346/226; 427/150; 427/152

[58] Field of Search ..... 346/201, 204, 205, 206, 346/208, 216, 225, 226; 427/150, 151, 152

[56] References Cited

U.S. PATENT DOCUMENTS 3,916,068 10/1975 Kohmura et al. ..... 346/205
4,020,232 4/1977 Kohmura et al. ..... 346/205
4,311,750 1/1982 Kubo et al. ..... 427/152

FOREIGN PATENT DOCUMENTS 6117684 10/1981 Japan ..... 346/204

*Primary Examiner*—Bruce H. Hess

*Attorney, Agent, or Firm*—Oblon, Fisher, Spivak, McClelland & Maier

[57] ABSTRACT

A two-color thermosensitive recording material comprising (a) a support material, (b) a high temperature thermosensitive color-forming layer formed on the support material, (c) an intermediate layer formed on the high temperature color-forming layer and (d) a low temperature color-forming layer formed on the intermediate layer; a two-color thermosensitive recording material comprising (a) a support material, (b) a high temperature thermosensitive color-forming layer formed on the support material, (c) a decolorizing layer, (d) an intermediate layer formed on the decolorizing layer and (e) a low temperature color-forming layer formed on the intermediate layer; and a two-color thermosensitive recording material comprising (a) a support material, (b) a decolorizing and color developing layer formed on the support material, (c) an intermediate layer formed on the decolorizing and color developing layer and (d) a two-color thermosensitive coloring layer capable of yielding two different colors when heated at different temperatures, with all the above intermediate layers comprising as the main component a vinylidene chloride resin.

10 Claims, No Drawings

TWO-COLOR THERMOSENSITIVE RECORDING MATERIAL

BACKGROUND OF THE INVENTION

The present invention relates to a two-color thermosensitive recording material capable of yielding two different colors when heated at different temperatures, comprising (a) a support material, (b) a high temperature color-forming layer formed on the support material, (c) an intermediate layer formed on the high temperature color-forming layer and (d) a low temperature color-forming layer formed on the intermediate layer; a two-color thermosensitive recording material comprising (a) a support material, (b) a high temperature thermosensitive color-forming layer formed on the support material, (c) a decolorizing layer formed on the high temperature color-forming layer, (d) an intermediate layer formed on the decolorizing layer and (e) a low temperature color-forming layer formed on the intermediate layer; and a two-color thermosensitive recording material comprising (a) a support material, (b) a decolorizing and color developing layer formed on the support material, (c) an intermediate layer formed on the decolorizing and color developing layer and (d) a two-color thermosensitive coloring layer capable of yielding two different colors when heated at different temperatures, with the key feature that all the above intermediate layers comprise as the main component a vinylidene chloride resin.

A conventional thermosensitive recording material comprises a support material and a thermosensitive coloring layer formed on the support material, capable of forming colored images in the thermosensitive coloring layer by application of heat thereto. For the heat application for image formation, a thermal head is in general use. As such thermosensitive recording material, a thermosensitive recording material of the type, in which (1) a colorless or light-colored leuco dye containing a lactone ring, a lactam ring or a spiropyran ring, and (2) a color developer capable of inducing a color in the leuco dye upon application of heat by the reaction with the leuco dye are employed, is widely used, since it is capable of yielding clear images with reduced fogging.

Because of the capability of forming colored images by simple application of heat, such thermosensitive recording materials are used, not only for copying books and documents, but also for recording output information from computers, facsimile apparatus, telex and other information transmission and measuring instruments. Depending upon the recording mode, it will be more convenient if it is allowed to record particular data in a different color from the remainder on a thermosensitive recording material, in order to display the particular data more distinctly from the remainder.

Recently, many trials have been made to attain recording with multiple colors by applying heat at different temperatures or by applying different quantities of thermal energy. Accordingly, a variety of multi-color thermosensitive recording materials have been proposed.

A conventional multi-color thermosensitive recording sheet comprises a support material and two thermosensitive color-forming layers overlaying the support material, which color-forming layers are colored in different colors upon application of different thermal energies thereto respectively. One layer is referred to as, for example, a high temperature color-forming layer and the other is referred to as, for example, a low temperature color-forming layer. The low temperature color-forming layer forms color at a low temperature, while the high temperature color-forming layer does not form color at all at the low temperature, but forms color at a high temperature which is higher than the low temperature, and the two colors are different from each other.

Such conventional multi-color thermosensitive recording sheets can be roughly classified into the following two types.

In one type, when a high temperature color-forming layer is colored by application of heat at a high temperature, the color developed in the high temperature color-forming layer is mixed with the color already developed in a low temperature color-forming layer, so that a color different from the color in the low temperature layer is produced in the high temperature color-forming layer.

In the other type, when the high temperature color-forming layer is colored, the color in the low temperature color-forming layer is decolorized by a decolorizing agent, so that only the high temperature color-forming layer is colored without the color of the low temperature color-forming layer being mixed therewith.

Specific examples of the former type are disclosed, for instance, in Japanese Patent Publications No. 49-69, No. 49-4342 and No. 49-27708, and Japanese Laid-Open Patent Applications No. 48-86543 and No. 49-65239.

Specific examples of the latter type are disclosed, for instance, in Japanese Patent Publications No. 50-17865, No. 50-17866, No. 51-29024 and No. 51-87542, and Japanese Laid-Open Patent Applications No. 50-18048 and No. 53-47843.

The former type has the shortcoming that the practically developable color systems are limited to such combinations that the colors developed at high temperature can overcome the color developed at low temperature, such as red (low temperature)—black (high temperature), and blue (low temperature)—black (high temperature).

In the latter type, there are no particular limitations to the combination of colors. As the decolorizing agents for decolorizing the color developed in the low temperature color-forming layer when developing a color in the high temperature color-forming layer, higher aliphatic alcohols, polyether, polyethylene glycol derivatives, nitrogen-containing compounds such as acetamide, stearamide, phthalonitrile, and amine derivatives such as guanidine derivatives are proposed. However, it has been discovered that the color developed in the low temperature color-forming layer is decolorized with time prior to the development of the color in the high temperature color-forming layer due to the effect of the above-mentioned decolorizing agents.

SUMMARY OF THE INVENTION

It is therefore an object of the present invention to provide a two-color thermosensitive recording material capable of yielding two different colors when heated at different temperatures, which colors are not discolored with time.

This object of the present invention can be attained by a two-color thermosensitive recording material comprising (a) a support material, (b) a high temperature thermosensitive color-forming layer formed on the support material, (c) an intermediate layer formed on the high temperature color-forming layer and (d) a low temperature color-forming layer formed on the intermediate layer; a two-color thermosensitive recording material comprising (a) a support material, (b) a high temperature thermosensitive color-forming layer formed on the support material, (c) a decolorizing layer, (d) an intermediate layer formed on the decolorizing layer and (e) a low temperature color-forming layer formed on the intermediate layer; and a two-color thermosensitive recording material comprising (a) a support material, (b) a decolorizing and color developing layer formed on the support material, (c) an intermediate layer formed on the decolorizing and color developing layer and (d) a two-color thermosensitive coloring layer capable of yielding two different colors when heated at different temperatures, with all the above intermediate layers comprising as the main component a vinylidene chloride resin.

DETAILED DESCRIPTION OF THE PREFERRED EMBODIMENTS

In a two-color thermosensitive recording material according to the present invention, which comprises (a) a support material, (b) a high temperature color-forming layer formed on the support material, (c) an intermediate layer formed on the high temperature color-forming layer and (d) a low temperature color-forming layer formed on the intermediate layer, the high temperature color-forming layer comprises a leuco dye, a color developer capable of inducing color formation in the leuco dye when heated at a predetermined high temperature, and a decolorizing agent, the low temperature color-forming layer comprises a leuco dye, a color developer capable of inducing color formation in the leuco dye when heated at a predetermined low temperature, the color developed in the low temperature color-forming layer is decolorized by the decolorizing agent contained in the high temperature color-forming layer when heated to a predetermined temperature beyond the predetermined low temperature, and the intermediate layer comprises as the main component a vinylidene chloride resin.

A two-color thermosensitive recording material according to the present invention, which comprises (a) a support material, (b) a high temperature color-forming layer formed on the support material, (c) a decolorizing layer, (d) an intermediate layer formed on the decolorizing layer and (e) a low temperature color-forming layer formed on the intermediate layer, is substantially the same as the above mentioned two-color thermosensitive recording material with respect to the compositions of the respective layers except that the high temperature color-forming layer does not contain the above-mentioned decolorizing agent for decolorizing the color developed in the low temperature color-forming layer, but the decolorizing layer layer contains the decolorizing agent.

In a two-color thermosensitive recording material according to the present invention, which comprises (a) a support material, (b) a decolorizing and color developing layer formed on the support material, (c) an intermediate layer formed on the decolorizing and color developing layer and (d) a two-color thermosensitive coloring layer capable of yielding two different colors when heated at different temperatures, with the above intermediate layer comprising as the main component a vinylidene chloride resin, the decoloring and color developing layer comprises a decoloring and color developing agent which serves as (i) the above-mentioned decolorizing agent for decoloring the color developed in the two-color thermosensitive coloring layer at a predetermined low temperature and as (ii) a color developer for developing a color in the two-color thermosensitive coloring layer at a predetermined high temperature, and the intermediate layer comprises as the main component a vinylidene chloride resin.

As the leuco dyes for use in the present invention, the leuco dyes conventionally employed in the field of thermosensitive recording materials can also employed. They can be used alone or in combination. Examples of such leuco dyes for use in the present invention are triphenylmethane-type leuco compounds, fluoran-type leuco compounds, phenothiazine-type leuco compounds, auramine-type leuco compounds and spiropyran-type leuco compounds. Specific examples of those leuco dyes are as follows:

3,3-bis(p-dimethylaminophenyl)-phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)-phthalide,
3-cyclohexylamino-6-chlorofluoran,
3-dimethylamino-5,7-dimethylfluoran,
3-diethylamino-7-chlorofluoran,
3-diethylamino-7-methylfluoran,
3-diethylamino-7,8-benzfluoran,
3-diethylaminobenzo[α]fluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran,
2-[N-(3′-trifluoromethylphenyl)amino]-6-diethylaminofluoran,
2-[3,6-bis(diethylamino)-9-(o-chloroanilino)xanthylbenzoic acid lactam],
3-diethylamino-6-methyl-7-(m-trichloromethylanilino)fluoran,
3-diethylamino-7-(o-chloroanilino)fluoran,
3-dibutylamino-7-(o-chloroanilino)fluoran,
3-N-methyl-N-amylamino-6-methyl-7-anilinofluoran,
3-N-methyl-N-cyclohexylamino-6-methyl-7-anilinofluoran,
3-diethylamino-6-methyl-7-anilinofluoran,
3-(N,N-diethylamino)-5-methyl-7-(N,N-dibenzylamino)fluoran,
benzoyl leuco methylene blue,
6′-chloro-8′-methoxy-benzoindolino-spiropyran,
6′-bromo-3′-methoxy-benzoindolino-spiropyran,
3-(2′-hydroxy-4′-dimethylaminophenyl)-3-(2′-methoxy-5′-chlorophenyl)phthalide,
3-(2′-hydroxy-4′-dimethylaminophenyl)-3-(2′-methoxy-5′-nitrophenyl)phthalide,
3-(2′-hydroxy-4′-dimethylaminophenyl)-3-(2′-methoxy-5′-methylphenyl)phthalide,
3-(2′-methoxy-4′-dimethylaminophenyl)-3-(2′-hydroxy-4′-chloro-5′-methylphenyl)phthalide,
3-morpholino-7-(N-propyl-trifluoromethylanilino)fluoran,
3-pyrrolidino-7-trifluoromethylanilinofluoran,
3-diethylamino-5-chloro-7-(N-benzyl-trifluoromethylanilino)fluoran,
3-pyrrolidino-7-(di-p-chlorophenyl)methylaminofluoran, 3-diethylamino-5-chloro-7-(α-phenylethylamino)fluoran, 3-(N-ethyl-p-toluidino)-7-(α-phenylethylamino)fluoran, 3-diethylamino-7-(o-methoxycarbonylphenylamino)-fluoran, 3-diethylamino-5-methyl-7-(α-phenylethylamino)fluoran, 3-diethylamino-7-piperidinofluoran, 2-chloro-3-(N-methyltoluidino)-7-(p-n-butylanilino)-fluoran, 3-(N-benzyl-N-cyclohexylamino)-5,6-benzo-7- -naphthylamino-4'-bromofluoran, and 3-diethylamino-6-methyl-7-mesidino-4',5'-benzofluoran.

As mentioned previously, these leuco dyes can be used alone or in combination.

Of the above mentioned leuco dyes, the following leuco dyes are particularly suitable for use in the high temperature color-forming layer:

3-diethylamino-7-chlorofluoran, 3-diethylamino-6-methyl-7-chlorofluoran, 3-cychohexylamino-6-chlorofluoran, and 3-diethylaminobezo[α]fluoran.

Furthermore, in the high temperature color-forming layer, the following acylated lactones and sultone-type acidic leuco dye can be contained in combination with guanidine type color developers which will be described later in detail. In this case, since the guanidine type color developers serve as decoloring agents for the color developed in the low temperature color-forming layer, a two-color thermosensitive recording material according to the present invention can be prepared by successively overlaying on a support material a high temperature color-forming layer containing at least one of the following acylated lactones and sultone-type acidic leuco dye and a guanidine type color developer for inducing color formation in the leuco dye, an intermediate layer and a low temperature color-forming layer containing a leuco dye and a color developer. In this recording material, the guanidine type color developer also serves as decoloring agent for decolorizing the color in the low temperature color-forming layer.

Another two-color thermosensitive recording material according to the present invention can be prepared by forming a layer containing a guanidine type color developer on a support material, an intermediate layer on the color developer layer thereon and a two-color thermosensitive color-forming layer containing a leuco dye, a color developer and one of the following acylated lactones and sultone-type acidic leuco dye, which two-color thermosensitive color-forming layer can yield two different colors when heated at different predetermined temperatures. In this recording material, the guanidine type color developer also serves as decoloring agent for decolorizing the color at a predetermined low temperature in the two-color thermosensitive color-forming layer.

Acylated Lactones and Sultone-Type Acidic Leuco Dyes

No. 1

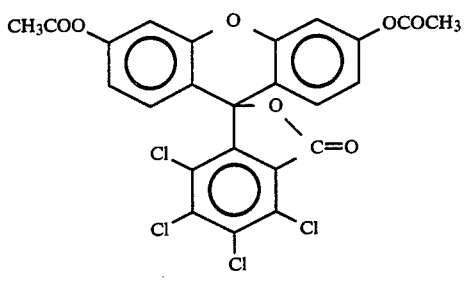

No. 2

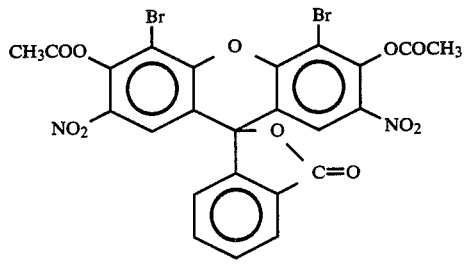

No. 3

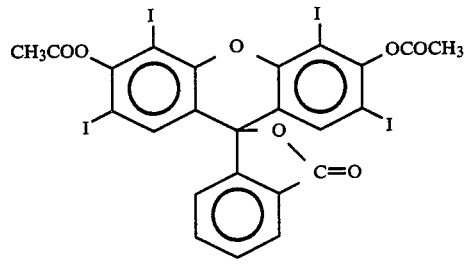

No. 4

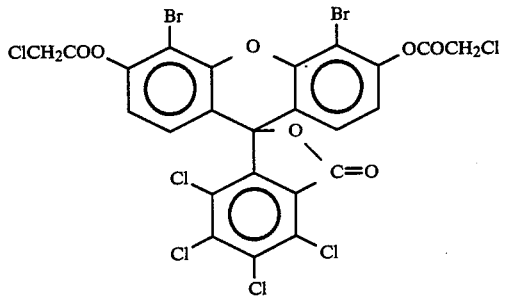

No. 5

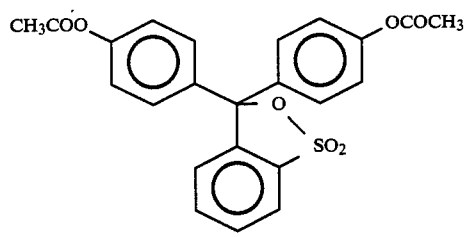

-continued

Acylated Lactones and Sultone-Type Acidic Leuco Dyes

No. 6

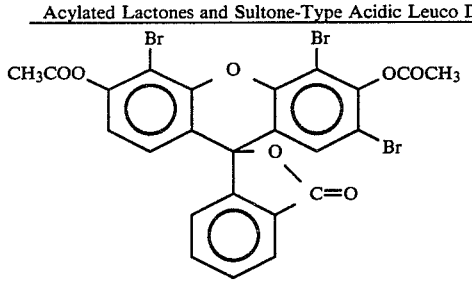

As the color developers capable of inducing color formation in the above mentioned leuco dyes, for example, the following can be employed:

N,N'-diphenylthiourea,
N-p-ethylphenyl-N'-phenylthiourea,
N-p-butylphenyl-N'-phenylthiourea,
N,N'-di(p-chlorophenyl)thiourea,
N,N'-di(m-trifluoromethylphenyl)thiourea,
N,N'-di(m-methylphenyl)thiourea,
4,4'-isopropylidenediphenol,
4,4'-isopropylidenebis(2-chlorophenol),
4,4'-isopropylidenebis(2,6-dibromophenol),
4,4'-isopropylidenebis(2,6-dichlorophenol),
4,4'-isopropylidenebis(2-methylphenol),
4,4'-isopropylidenebis(2-tert-butylphenol),
4,4'-sec-butylidenediphenol,
4,4'-cychlohexylidenebis(2-methylphenol),
4-tert-butylphenol,
4-phenylphenol,
4-hydroxydiphenoxide,
α-naphthol,
β-naphthol,
3,5-xylenol,
thymol,
methyl 4-hydroxybenzoate,
4-hyroxyacetophenone,
novolak-type phenolic resin,
2,2'-thiobis(4,6-dichlorophenol),
catechol,
resorcinol,
hydroquinone,
pyrogallol,
phloroglucine,
phloroglucinocarboxylic acid,
4-tert-octylcatechol,
2,2'-methylenebis(4-chlorophenol),
2,2'-methlenebis(4-methyl-6-tert-butylphenol),
2,2'-dihydroxy-diphenyl,
ethyl p-hydroxybenzoate,
propyl p-hydroxybenzoate,
butyl p-hydroxybenzoate,
benzyl p-hydroxy-benzoate,
p-chlorobenzyl p-hydroxybenzoate,
o-chlorobenzyl p-hydroxybenzoate,
p-methylbenzyl p-hydroxybenzoate,
n-octyl benzoic acid p-hydroxybenzoate,
zinc salicylate,
1-hydroxy-2-naphthoic acid,
2-hydroxy-6-naphthoic acid,
zinc 2-hydroxy-6-naphthoate,
4-hydroxy diphenyl sulfone,
4-hydroxy-4'-chlorodiphenyl sulfone, and
bis(4-hydroxyphenyl)sulfide.

In addition to the above color developers, the following guanidine type basic compounds (hereinafter referred to as the guanidine derivatives) can be employed. As mentioned prevously, these guanidine derivatives can also be employed as decolorizing agents for decolorizng the color developed in the low temperature color-forming layer.

Guanidine Derivatives

No. 1

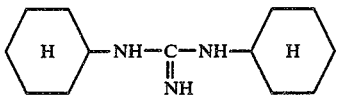

No. 2

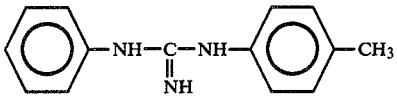

No. 3

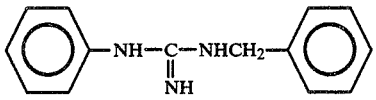

No. 4

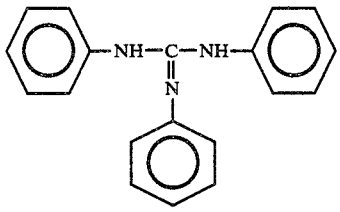

No. 5

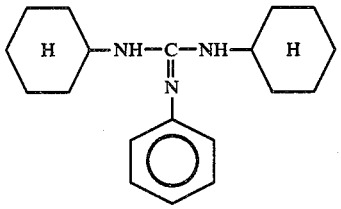

No. 6

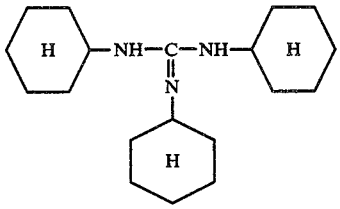

No. 7

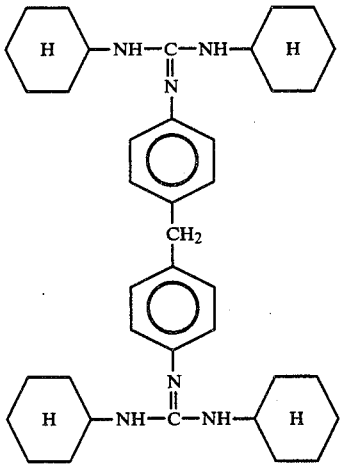

-continued

Guanidine Derivatives

No. 8

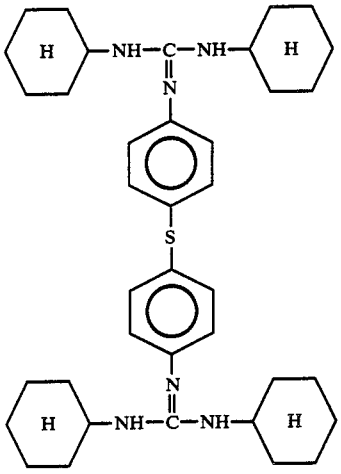

In the present invention, a wide variety of conventional binder agents can be employed for binding the above-mentioned leuco dyes and color developers in each layer and for fixing the coloring layer to the support material and the other layer in contact therewith.

Examples of the binder agents are as follows: polyvinyl alcohol; starch and starch derivatives; cellulose derivatives such as methoxycellulose, hydroxyethylcellulose, carboxymethylcellulose, methylcellulose and ethylcellulose; water-soluble polymeric materials such as sodium polyacrylate, polyvinylpyrrolidone, acrylamide/acrylic acid ester copolymer, acrylamide/acrylic acid ester/methacrylic acid three-dimensional copolymer, styrene/maleic anhydride copolymer alkali salt, isobutylene/maleic anhydride copolymer alkali salt, polyacrylamide, sodium alginate, gelatin and casein; and latexes of polyvinyl acetate, polyurethane, styrene/butadiene copolymer, polyacrylic acid, polyacrylic acid ester, vinyl chloride/vinyl acetate copolymer, polybutylmethacrylate, ethylene/vinyl acetate copolymer and styrene/butadiene/acryl-type copolymer.

In the present invention, when necessary, auxiliary additives which are conventionally employed in the thermosensitive recording materials of this type, for example, fillers, surface active agents and thermofusible materials, can be added to the above mentioned leuco dyes and color developers.

Specific examples of the fillers are calcium carbonate, silica, zinc oxide, titanium oxide, aluminum hydroxide, zinc hydroxide, barium sulfate, clay, talc, surface-treated inorganic powder, for example, of calcium and silica, and powder of organic materials, such as urea-formaldehyde resin, styrene/methacrylic acid copolymer and polystyrene.

Specific examples of the thermofusible materials are higher fatty acids, esters, amides and metal salts of higher fatty acids, a variety of waxes, condensates of aromatic carboxylic acids and amines, benzoic acid phenyl esters, higher straight-chain glycols, 3,4-epoxydialkyl hexahydrophthalate, higher ketones, and other thermo-fusible organic compounds having a melting point in the range of about 50° C. to about 200° C.

As the decolorizing agents for use in the present invention, conventional decolorizing agents, for example, polyether, polyethylene glycol derivatives, solid alcohols, aliphatic amines, aromatic amines, guanidine derivatives and morpholine derivatives, can be employed.

In the present invention, an intermediate layer containing as the main component vinylidene chloride resin is interposed (1) between the high temperature color forming layer and the low temperature color forming layer, (2) between the the low temperature color-forming layer and the decolorizing layer formed on the high temperature coloring-forming layer, or (3) between the two-color thermosensitive color-forming layer and the decolorizing and color developing layer formed on the support material.

It is preferable that the intermediate layer contain a thermofusible material having a melting point ranging from about 50° C. to about 200° C. Specific examples are those previously mentioned for use with the leuco dyes and color developers.

By referring to the following examples, the present invention will now be explained in detail.

EXAMPLE 1

(1) Preparation of Low Temperature Color-Forming Layer Formation Liquid

Dispersions A and B were prepared by dispersing the components of each dispersion in a sand mill until the average particle size of each solid component became 2 to 3 μm.

| | Parts by Weight |
|---|---|
| Dispersion A | |
| 3-(N—ethyl-N—amylamino)-6-methyl-7-anilinofluoran (Black) | 20 |
| 10% aqueous solution of hydroxyethylcellulose | 20 |
| Water | 60 |
| Dispersion B | |
| 3,3-dichlorophenylthiourea | 10 |
| Calcium carbonate | 10 |
| 10% aqueous solution of polyvinyl alcohol | 20 |
| Water | 60 |

10 Parts by weight of the above prepared Dispersion A, 70 parts by weight of Dispersion B and 20 parts by weight of water were mixed well, so that a low temperature color-forming layer formation liquid was prepared.

(2) Preparation of High Temperature Color-Forming Layer Formation Liquid

| | Parts by Weight |
|---|---|
| Dispersion C | |
| 3-diethylamino-7-chlorofluoran (Red) | 20 |
| 10% aqueous solution of hydroxyethylcellulose | 20 |
| Water | 60 |
| Dispersion D | |
| Bisphenol A | 10 |
| Calcium carbonate | 10 |
| 10% aqueous solution of hydroxyethylcellulose | 15 |
| Water | 65 |

10 Parts by weight of the Dispersion C, 70 parts by weight of Dispersion D and 20 parts by weight of water were mixed well, so that a high temperature color-forming layer formation liquid was prepared.

(3) Preparation of Decolorizing Layer Formation Liquid

A decolorizing layer formation liquid was prepared by dispersing the following components in a ball mill:

| | Parts by Weight |
|---|---|
| 4,4'-dithiomorpholine | 20 |
| 10% aqueous solution of polyvinyl alcohol | 20 |
| Water | 60 |

(4) Preparation of Intermediate Layer Formation Liquid

A polyvinylidene chloride latex (with 45% of the solid component) was employed as an intermediate layer formation liquid.

The high temperature color-forming layer formation liquid was first coated on a sheet of commercially available high quality paper (with a basis weight of about 52 g/m$^2$) with a deposition of 5 g/m$^2$ when dried, so that a high temperature color-forming layer was formed on the high quality paper.

The decolorizing layer formation liquid was then coated on the high temperature color-forming layer with a deposition of 2.5 g/m$^2$ when dried, so that a decolorizing layer was formed on the high temperature color-forming layer.

The intermediate layer formation liquid was coated on the decolorizing layer with a deposition of 2.0 g/m$^2$ when dried, so that an intermediate layer was formed on the decolorizing layer.

Finally, the low-temperature color-forming layer formation liquid was coated on the intermediate layer with a deposition of 3.5 g/m$^2$ when dried, so that a two-color thermosensitive recording material was prepared. This two-thermosensitive recording material was subjected to calendering so as to have a smoothness of 500 sec to 1500 sec, whereby a two-thermosensitive recording material No. 1 according to the present invention was prepared.

EXAMPLE 2

(1) Preparation of Two-Color Thermosensitive Color-Forming Layer Formation Liquid Dispersions A, D and E were prepared by dispersing the components of each dispersion in a sand mill until the average particle size of each solid component became 2 to 3 μm. Dispersions A and D were the same as those employed in Example 1.

| | Parts by Weight |
|---|---|
| Dispersion A | |
| 3-(N—ethyl-N—amylamino)-6-methyl-7-anilinofluoran (Black) | 20 |
| 10% aqueous solution of hydroxyethylcellulose | 20 |
| Water | 60 |
| Dispersion D | |
| Bisphenol A | 10 |
| Calcium carbonate | 10 |
| 10% aqueous solution of hydroxyethylcellulose | 15 |
| Water | 65 |

-continued

| | Parts by Weight |
|---|---|
| Dispersion E | |
| Acylated acidic leuco dye No. 6 | 20 |
| 10% aqueous solution of hydroxyethylcellulose | 20 |
| Water | 60 |

10 Parts by weight of the above prepared Dispersion A, 70 parts by weight of Dispersion D, 10 parts by weight of Dispersion E and 10 parts by weight of water were mixed well, so that a two-color thermosensitive color-forming layer formation liquid was prepared.

(2) Preparation of Decolorizing and Color Developing Layer Formation Liquid

A decolorizing and color developing layer formation liquid E was prepared by dispersing the following components in a ball mill:

| | Parts by Weight |
|---|---|
| Guanidine Derivative No. 5 | 20 |
| 10% aqueous solution of polyvinyl alcohol | 20 |
| Water | 60 |

(3) Preparation of Intermediate Layer Formation Liquid

A polyvinylidene chloride latex (with 45% of the solid component) was employed as an intermediate layer formation liquid.

The decolorizing and color developing layer formation liquid was first coated on a sheet of commercially available high quality paper (with a basis weight of about 52 g/m$^2$) with a deposition of 5 g/m$^2$ when dried, so that a decolorizing and color developing layer was formed on the high quality paper.

The intermediate layer formation was then coated on the decolorizing and color developing layer with a deposition of 2.0 g/m$^2$ when dried, so that an intermediate layer was formed on the decoloring and color developing layer.

Finally, the two-color thermosensitive color-forming layer formation liquid was coated on the intermediate layer with a deposition of 4.5 g/m$^2$ when dried, whereby a two-color thermosensitive recording material was prepared. This two-color thermosensitive recording material was subjected to the same calendering as in Example 1, whereby a two-color thermosensitive recording material No. 2 according to the present invention was prepared.

COMPARATIVE EXAMPLE 1

Example 1 was repeated except that the intermediate layer was not formed, whereby a comparative two-color thermosensitive recording material No. 1 was prepared.

COMPARATIVE EXAMPLE 2

Example 2 was repeated except that the intermediate layer was not formed, whereby a comparative two-color thermosensitive recording material No. 2 was prepared.

EXAMPLE 3

Preparation of Intermediate Layer Formation Liquid

50 Parts by weight of a dispersion consisting of 20 parts by weight of m-xylenebisstearamide, 40 parts by weight of a 5% aqueous solution of methylcellulose and 40 parts by weight of water was mixed with 22 parts by weight of a polyvinylidene chloride latex (containing 45 wt. % of the solid component) and 28 parts by weight of water, so that an intermediate layer formation liquid was prepared.

Example 1 was repeated except that the intermediate layer formation liquid employed in Example 1 was replaced by the above prepared intermediate layer formation liquid, with a coating amount thereof (when dried) being 2.5 g/m$^2$, and the depostion of the decolorizing layer was increased to 3.0 g/m$^2$, whereby a two-color thermosensitive recording material No. 3 according to the present invention was prepared.

EXAMPLE 4

(1) Preparation of Two-Color Thermosensitive Color-Forming Layer Formation Liquid Dispersions A, D and E were prepared by dispersing the components of each dispersion in a sand mill until the average particle size of each solid component became 2 to 3 μm. Dispersions A, D and E were the same as those employed in Example 3.

| | Parts by Weight |
|---|---|
| Dispersion A | |
| 3-(N—ethyl-N—amylamino)-6-methyl-7-anilinofluoran (Black) | 20 |
| 10% aqueous solution of hydroxyethylcellulose | 20 |
| Water | 60 |
| Dispersion D | |
| Bisphenol A | 10 |
| Calcium carbonate | 10 |
| 10% aqueous solution of hydroxyethylcellulose | 15 |
| Water | 65 |
| Dispersion E | |
| Acylated acidic leuco dye No. 6 | 20 |
| 10% aqueous solution of hydroxyethylcellulose | 20 |
| Water | 60 |

10 Parts by weight of the above prepared Dispersion A, 70 parts by weight of Dispersion D, 10 parts by weight of Dispersion E and 10 parts by weight of water were mixed well, so that a two-color thermosensitive color-forming layer formation liquid was prepared.

(2) Preparation of Decolorizing and Color Developing Layer Formation Liquid

A decolorizing layer formation liquid F was prepared by dispersing the following components in a ball mill:

| | Parts by Weight |
|---|---|
| Guanidine Derivative No. 5 | 20 |
| 10% aqueous solution of polyvinyl alcohol | 20 |
| Water | 60 |

(3) Preparation of Intermediate Layer Formation Liquid

50 Parts by weight of a dispersion consisting of 20 parts by weight of m-xylenebisstearamide, 40 parts by weight of a 5% aqueous solution of methylcellulose and 40 parts by weight of water was mixed with 22 parts by weight of a polyvinylidene chloride latex (containing 45 wt. % of the solid component) and 28 parts by weight of water, so that the same intermediate layer formation liquid as that employed in Example 3 was prepared.

The decolorizing and color developing layer formation liquid was coated on a sheet of commercially available high quality paper (with a basis weight of about 52 g/m$^2$) with a deposition of 5 g/m$^2$ when dried, so that a decolorizing and color developing layer was formed on the high quality paper.

The intermediate layer formation was then coated on the decolorizing layer with a deposition of 2.5 g/m$^2$ when dried, so that an intermediate layer was formed on the decoloring layer formation liquid.

Finally, the two-color thermosensitive color-forming layer formation liquid was coated on the intermediate layer with a deposition of 4.5 g/m$^2$ when dried, whereby a two-color thermosensitive recording material was prepared. This two-color thermosensitive recording material was subjected to the same calendering as in Example 1, whereby a two-color thermosensitive recording material No. 4 according to the present invention was prepared.

The two-color thermcsensitive recording materials No. 1 through No. 4 according to the present invention and the comparative two-color thermosensitive recording materials No. 1 and No. 2 were subjected to thermal printing by use of a G-III facsimile test apparatus including a thermal head (made by Matsushita Electronic Components Co., Ltd.) having 8 dots per mm, with a heat emitting resistance being about 400 ohm/dot, under the conditions that the power applied to the head was 0.6 W/dot, the main scanning speed was 20 msec/-line and the subscanning recording speed was 3.58 l/mm, and the pressure application by the platen was 3.0 kg/cm$^2$. The density of the developed images was measured by Macbeth densitometer RD-514 with a filter W-106 for black and a filter W-58 for red. The results were as follows:

TABLE 1

| Thermosensitive Recording Material | Developed Image Density | | |
|---|---|---|---|
| | High Temp. Color (Black) | Low Temp. Color (Red) | Low Temp. Color (1 month) |
| Example No. 1 | 1.10 (1.0 mJ/dot) | 1.00 (2.0 mJ/dot) | 1.09 |
| Example No. 2 | 0.8 (1.0 mJ/dot) | 0.73 (3.0 mJ/dot) | 0.80 |
| Example No. 3 | 1.10 (1.10 mJ/dot) | 1.03 (2.0 mJ/dot) | 1.07 |
| Example No. 4 | 0.8 (1.0 mJ/dot) | 0.75 (3.0 mJ/dot) | 0.80 |
| Comp. Example No. 1 | 1.07 (1.0 mJ/dot) | 0.97 (2.0 mJ/dot) | 0.33 |
| Comp. Example No. 2 | 0.76 (1.0 mJ/dot) | 0.70 (3.0 mJ/dot) | 0.40 |

In the above table, High Temp. Color (Black) indicates the color developed at a predetermined high temperature, which was black; Low Temp. Color (Red) indicates the color developed at a predetermined low temperature, which was red; and Low Temp. Color (1 month) indicates the color (developed at a predetermined low temperature) after one month.

As can be seen from the above table, the two-color thermosensitive recording materials according to the present invention yielded black images at low temperatures and red images at high temperatures with high density, and by interposing the intermediate layer containing a vinylidene chloride resin as the main component between the high temperature color forming layer and the low temperature color forming layer, between the the low temperature color-forming layer and the decolorizing layer formed on the low-temperature coloring layer, or between the two-color thermosensitive color-forming layer and the decolorizing layer and color developing layer formed on the support material, the preservability of the colors developed in the low-temperature coloring layer can be significantly improved as compared with the comparative examples.

What is claimed is:

1. In a two-color thermosensitive recording material capable of forming two different colors when heated at different temperatures, selected from the group consisting of a two-color thermosensitive recording material comprising (a) a support material, (b) a high temperature color-forming layer formed on the support material, comprising a leuco dye, a color developer capable of inducing color formation in the leuco dye to produce a high temperature color when heated to a predetermined high temperature, and a decolorizing agent, (c) an intermediate layer formed on the high temperature color-forming layer and (d) a low temperature color-forming layer formed on the intermediate layer, comprising a leuco dye and a color developer capable of inducing color formation in the leuco dye to produce a low temperature color when heated to a predetermined low temperature, said low temperature color being decolorized by said decolorizing agent contained in said high temperature color-forming layer when heated to a predetermined temperature beyond said predetermined low temperature; a two-color thermosensitive recording material comprising (a) a support material, (b) a high temperature color-forming layer formed on the support material, comprising a leuco dye and a color developer capable of inducing color formation in the leuco dye to produce a high temperature color when heated to a predetermined high temperature, (b) a decolorizing layer formed on the high temperature color-forming layer, comprising a decolorizing agent, (c) an intermediate layer formed on the decolorizing layer and (d) a low temperature color-forming layer formed on the intermediate layer, comprising a leuco dye and a color developer capable of inducing color formation in the leuco dye to produce a low temperature color when heated to a predetermined low temperature, said low temperature color being decolorized by said decolorizing agent contained in said decolorizing layer when heated to a predetermined temperature beyond said predetermined low temperature; and a two-color thermosensitive recording material comprising (a) a support material, (b) a decolorizing and color developing layer formed on the support material, comprising a color developer, (c) an intermediate layer formed on the decolorizing and color developing layer and (d) a two-color thermosensitive coloring layer capable of yielding two different colors when heated at different temperatures, comprising a first leuco dye and a first color developer for inducing color formation in said leuco dye when heated to a predetermine low temperature to produce a low temperature color, and a second leuco dye which is colored in reaction with said color developer contained in said decolorizing and color developing layer when heated to a predetermined high temperature to produce a high temperature color, said low temperature color being decolorized by said color developer contained in said decolorizing and color developing layer when heated to a predetermined temperature beyond said low temperature temperature, the improvement wherein said intermediate layer comprises as the main component a vinylidene chloride resin.

2. A two-color thermosensitive recording material as claimed in claim 1, wherein said intermediate layer further comprises a thermofusible material having a melting point ranging from about 50° C. to about 200° C.

3. A two-color thermosensitive recording material as claimed in claim 2, wherein said thermofusible material is selected from the group consisting of higher fatty acids, esters, amides and metal salts of higher fatty acids, a variety of waxes, condensates of aromatic carboxylic acids and amines, benzoic acid phenyl esters, higher straight-chain glycols, 3,4-epoxy-dialkyl hexahydrophthalate and higher ketones.

4. A two-color thermosensitive recording material capable of forming two different colors when heated at different temperatures, comprising:

(a) a support material, (b) a high temperature color-forming layer formed on the support material, comprising a leuco dye, a color developer capable of inducing color formation in the leuco dye to produce a high temperature color when heated to a predetermined high temperature, and a decolorizing agent, (c) an intermediate layer formed on the high temperature color-forming layer, comprising a vinylidene chloride resin, and (d) a low temperature color-forming layer formed on the intermediate layer, comprising a leuco dye and a color developer capable of inducing color formation in the leuco dye to produce a low temperature color when heated to a predetermined low temperature, said low temperature color being decolorized by said decolorizing agent contained in said high temperature color-forming layer when heated to a predetermined temperature beyond said predetermined low temperature.

5. A two-color thermosensitive recording material as claimed in claim 4, wherein said intermediate layer further comprises a thermofusible material having a melting point ranging from about 50° C. to about 200° C.

6. A two-color thermosensitive recording material capable of forming two different colors when heated at different temperatures, comprising:

(a) a support material, (b) a high temperature color-forming layer formed on the support material, comprising a leuco dye and a color developer capable of inducing color formation in the leuco dye to produce a high temperature color when heated to a predetermined high temperature, (c) a decolorizing layer formed on the high temperature color-forming layer, comprising a decolorizing agent, (d) an intermediate layer formed on the decolorizing layer, comprising as the main component a vinylidene chloride resin, and (e) a low temperature color-forming layer formed on the intermediate layer, comprising a leuco dye and a color developer capable of inducing color formation in the leuco dye to produce a low temperature color when heated to a predetermined low temperature, said low temperature color being decolorized by said decolorizing agent contained in said decolorizing layer when heated to a predetermined temperature beyond said predetermined low temperature.

7. A two-color thermosensitive recording material as claimed in claim 6, wherein said intermediate layer further comprises a thermofusible material having a melting point ranging from about 50° C. to about 200° C.

8. A two-color thermosensitive recording material capable of forming two different colors when heated at different temperatures, comprising:

(a) a support material, (b) a decolorizing and color developing layer formed on the support material, comprising a color developer, (c) an intermediate layer formed on the decolorizing and color developing layer, comprising as the main component a vinylidene chloride resin, and (d) a two-color thermosensitive coloring layer capable of yielding two different colors when heated at different temperatures, comprising a first leuco dye and a first color developer for inducing color formation in said first leuco dye when heated to a predetermine low temperature to produce a low temperature color, and a second leuco dye which is colored in reaction with said color developer contained in said decolorizing and color developing layer when heated to a predetermined high temperature to produce a high temperature color, said low temperature color being decolorized by said color developer contained in said decolorizing and color developing layer when heated to a predetermined temperature beyond said low temperature temperature.

9. A two-color thermosensitive recording material as claimed in claim 8, wherein said color developer contained in said decolorizing and color developing layer is a guanidine derivative selected from the group consisting of:

No. 1

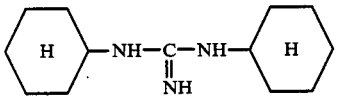

No. 2

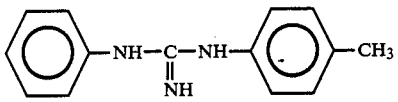

No. 3

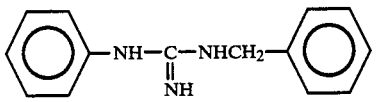

-continued

No. 4

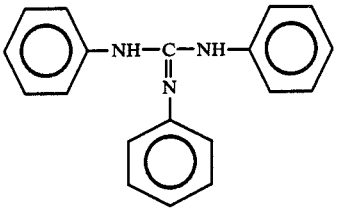

No. 5

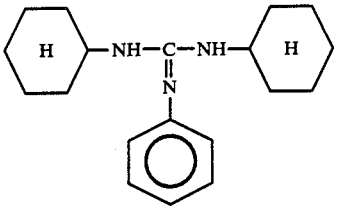

No. 6

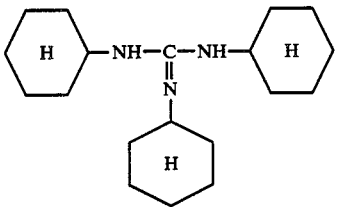

No. 7

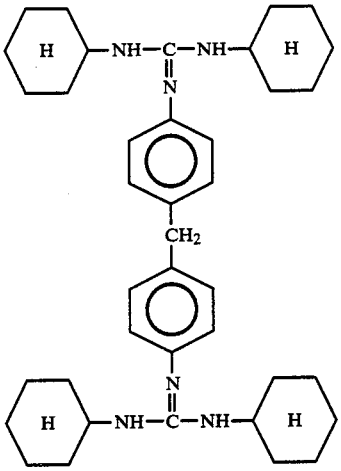

No. 8

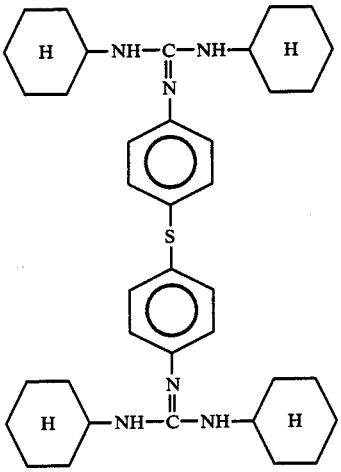

10. A two-color thermosensitive recording material as claimed in claim 8, wherein said intermediate layer further comprises a thermofusible material having a melting point ranging from about 50° C. to about 200° C.

* * * * *